US005428325A

United States Patent [19]

Jachowski et al.

[11] Patent Number: 5,428,325

[45] Date of Patent: Jun. 27, 1995

[54] RF FILTERS AND MULTIPLEXERS WITH RESONATOR DECOUPLERS

[75] Inventors: Douglas R. Jachowski, Reno, Nev.; David P. Halley, Bentleyville, Ohio; Chia-Sam Wey, Reno, Nev.

[73] Assignee: Allen Telecom Group, Inc., Solon, Ohio

[21] Appl. No.: 165,040

[22] Filed: Dec. 10, 1993

[51] Int. Cl.[6] ..... H01P 1/205

[52] U.S. Cl. ..... 333/203; 333/134; 333/206

[58] Field of Search ..... 333/134, 202, 203, 206, 333/207, 222, 223; 455/82

[56] References Cited

U.S. PATENT DOCUMENTS

| | | | |
|---|---|---|---|
| 3,562,677 | 2/1971 | Gunderson | 333/203 |
| 4,450,421 | 5/1984 | Meguro et al. | 333/203 X |
| 4,937,533 | 6/1990 | Livingston | 333/203 X |
| 5,023,579 | 6/1991 | Bentivenga et al. | 333/203 |
| 5,208,565 | 5/1993 | Sogo et al. | 333/206 |

FOREIGN PATENT DOCUMENTS

| | | | |
|---|---|---|---|
| 0053201 | 3/1983 | Japan | 333/202 |

*Primary Examiner*—Seungsook Ham

*Attorney, Agent, or Firm*—Laff, Whitesel, Conte & Saret, Ltd.

[57] ABSTRACT

An RF filter having a housing defining a cavity with plural elongated resonators and plural resonator decouplers adjacent each of plural pairs of the resonators in the housing. The decouplers are grounded adjacent each of their ends only to the housing to provide an enhanced resonator decoupling effect. The filter may instead comprise a dielectric block with resonator holes and resonator decoupler holes each appropriately metalized with the decoupler holes being grounded at each end at external metalized block surfaces.

13 Claims, 4 Drawing Sheets

RF FILTERS AND MULTIPLEXERS WITH RESONATOR DECOUPLERS

BACKGROUND OF THE INVENTION

Radio frequency (RF) filters and multiplexers having filters typically employ a plurality of resonators. So that such filters will function as intended and designed, each resonator must be suitably decoupled from its neighbors. This is most frequently accomplished by spacing the resonators at sufficient distances from each other to avoid excessive coupling.

However, in many environments space is at a premium. This requires resonators to be physically positioned closer together than is otherwise desirable. Under such circumstances a variety of techniques have been employed to provide for suitable decoupling. One typical approach has been to insert a dividing wall between adjacent resonators. Another has been to use mechanical irises. Each of these involves substantial expense.

It would be desirable to provide a less expensive, potentially adjustable, possibly more effective decoupling mechanism, especially for metal interdigital and combline filters, i.e., metal filters employing resonators arranged in interdigital and combline arrays, as well as for dielectric block filters.

SUMMARY OF THE INVENTION

Improved RF filters are provided in accordance with this invention. The improved filters are rectangular and have interdigital or combline arrays of elongated resonators and a plurality of elongated resonator decouplers, one decoupler being positioned adjacent or between each of a plurality of pairs of adjacent elongated resonators. The filter has a length defined by ends, a width defined by side walls, and a height defined by a top wall and a bottom wall, at least two of which walls define conductive surfaces.

Each elongated resonator has a length which is substantially greater than its greatest transverse dimension. The resonators are arrayed along the length of the filter with their lengths extending in the direction of the filter height. Each resonator is electrically connected adjacent one of its ends to one of the conductive surfaces. Each resonator decoupler has a length which is at least equal to that of the resonators and extends in the same direction as the lengths of an adjacent pair of resonators. The greatest transverse dimension of the decoupler is less than the greatest transverse dimension of the pairs of adjacent resonators. Each decoupler is electrically grounded to conductive surfaces adjacent each of its ends.

In one form, the filter ends, side walls, and top wall and bottom wall are conductive plates defining a cavity, the resonators and resonator decouplers are positioned in the cavity, and the resonator decouplers are electrically connected at their ends to the top and bottom plates. Preferably, the resonator decouplers are rods, which in a preferred form in transverse cross-section have dimensions which are no greater than a two to one ratio. The resonators may be arrayed in a combline or interdigital array and the decouplers may be grounded at each of their ends to one or two walls of the filter. The cavities may be rectangular or in a duplexer may be L-shaped or U-shaped.

In another form, the filter is a dielectric block, the resonators are holes in the block, and the resonator decouplers are holes in the block. The exterior surfaces of the block and the interior surfaces of the resonator holes and the resonator decoupler holes are at least partially covered with a conductive layer, with the resonator decoupler hole coverings being along the entire lengths of the decoupler holes and connected to coverings on the exterior surfaces of the block at both ends of the decoupler holes, whereas the resonator hole coverings are connected to coverings on the exterior surface of the block at only one end of the resonator holes. The dielectric block filter may be an interdigital filter or a combline filter.

Further objects, features and advantages of the present invention will become apparent from the following description and drawings.

DESCRIPTION OF THE PREFERRED EMBODIMENTS

Figure 1:
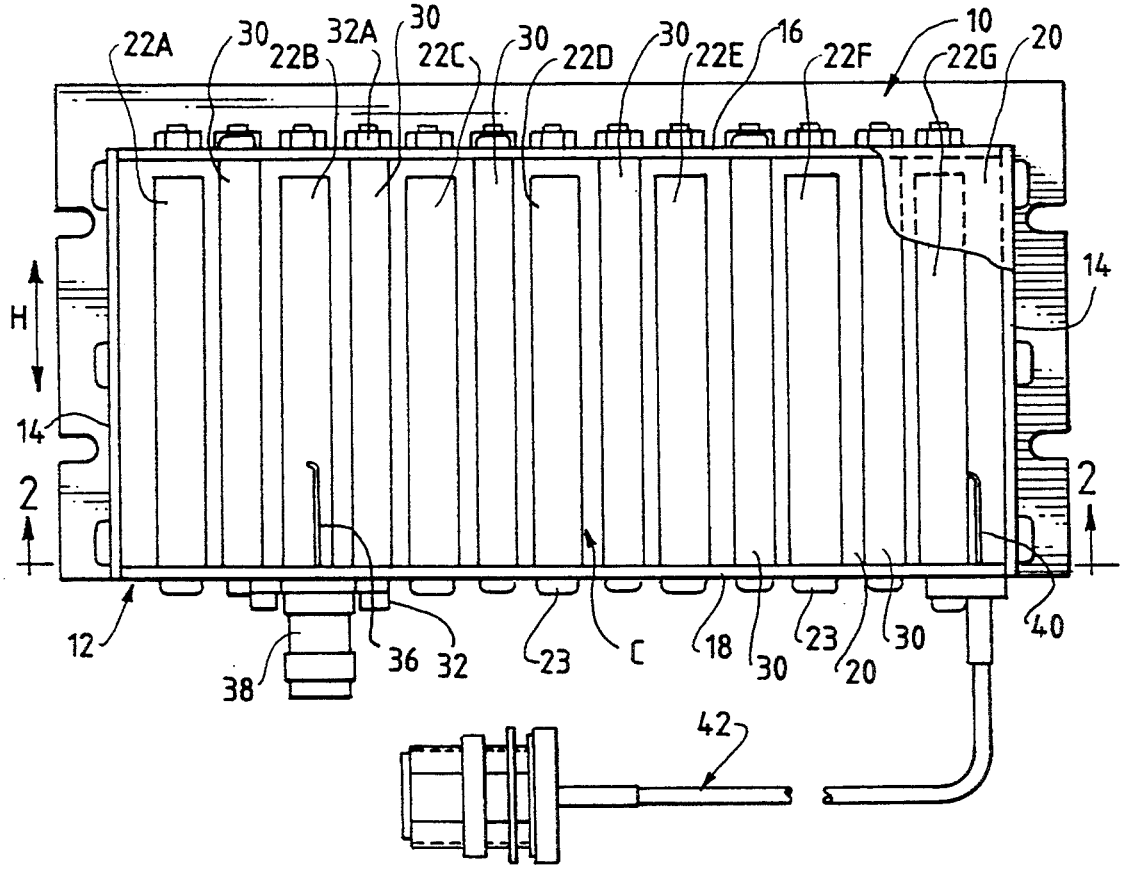
FIG. 1 is a side elevational view, with a side plate removed, of a combline filter of the present invention.
Figure 2:
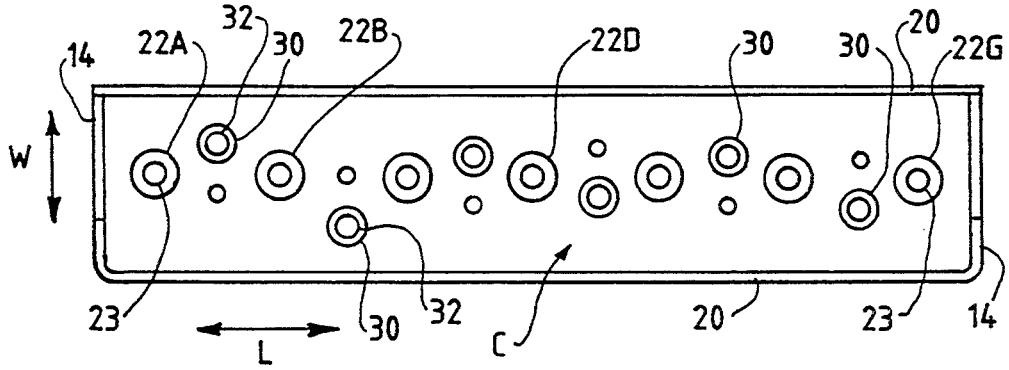
FIG. 2 is a sectional view taken along line 2—2 of FIG. 1.

Referring now to FIGS. 1 and 2, a combline receiver filter 10 in accordance with the present invention is generally rectangular and includes an elongated, generally rectangular conductive housing 12. Housing 12 is preferably metallic, as of copper. Housing 12 has a pair of end walls or plates 14 defining its length L, a top wall or plate 16 and a bottom wall or plate 18 defining its height H, and side walls or plates 20 defining its width W. One of the plates 20 in FIG. 1 is broken away for clarity of illustration of filter 10. The plates are connected in any suitable fashion to define a thin elongated rectangular cavity C.

Inside the cavity a selected plurality of elongated resonators 22A, 22B, . . . 22G are disposed. Each of the resonators, in the embodiment shown, is rod-like in shape, is metallic, as of copper, and is generally circular in transverse cross-section. All of the rods and housing plates may be coated with silver to provide high surface conductivity in accordance with conventional practice.

As may be seen in FIGS. 1 and 2, each resonator 22A, . . . has a length which is substantially greater than any dimension in transverse cross-section. Further, it will be seen that the resonators are arranged along the length of the housing with their lengths extending normal to the top plate 16 and bottom plate 18, hence in the direction of and parallel to the housing height H. The resonators are each connected to the housing adjacent one end of the resonator, and preferably to the end itself, to provide a firm and secure mechanical and electrical connection. Although a threaded fastener such as a screw 23 is a preferred method of connection, soldering, casting or the like may be used as well.

To reduce the spacing otherwise required between adjacent resonators to avoid deleterious electrical coupling, hence degradation of operation, the filter 10 incorporates a plurality of decouplers 30 which substantially reduce the coupling effect between adjacent resonators, i.e., the pair of resonators between which the decoupler is positioned. Decouplers 30 are disposed in the housing between adjacent resonators. Each decoupler has a length which is greater than the lengths of the adjacent resonators, and extends in the same direction as (parallel to) the resonators. As may be seen each decoupler is mechanically secured and electrically grounded adjacent each end to the housing plates 16, 18, and preferably by screws 32 which extend through the top and bottom plates into the ends of the decouplers 30 to provide a low-loss connection.

In the form illustrated, the decouplers 30 are rods such as round rods, having openings at their ends to receive the screws 32.

It is to be understood that the terms "decoupling" and "decoupler" are used herein to refer to the desired reduction or adjustment of the coupling between resonators, and neither to increasing coupling nor to eliminating coupling.

Although the resonators and decouplers have been shown as round rods, other shapes in transverse cross-section may be used as well for each of them, and the resonators and decouplers need not be of the same cross-sectional shape in any particular filter. However, the filter construction described employs decouplers having important dimensional relationships as compared to the resonators and housing. Thus, as viewed in transverse cross-section, the greatest transverse dimension of the decouplers is less than that of the adjacent resonators. In a most preferred form, the greatest transverse dimension of the decouplers is no more than one-half that of the adjacent resonators greatest transverse dimension. Further, the cross-sectional configuration of each decoupler is such that its greatest dimension is preferably no more than about twice its smallest dimension. In the case of the round rods shown, those dimensions are equal, and could be nearly equal for some regular polygonal rods. For irregular polygonal rods, those dimensions could be substantially different, but preferably do not differ by more than the about two to one ratio. Further, the decouplers 30 are secured to a maximum of two walls of the housing (both ends could be connected to a single side wall), and not to three or four walls or plates of the housing 12.

Thus, despite the fact that the decouplers do not wall off or provide a full mechanical barrier between the adjacent resonators (or sometimes any apparent mechanical barrier at all), they function to effectively decouple adjacent resonators despite the fact that the physical distance between resonators would, in the absence of an associated decoupler, excessively couple and thereby detract from the operation of the adjacent resonators, and degrade and deleteriously affect the operation of the filter.

The filter 10 is provided with suitable connectors for electrically connecting it to an antenna and to another input or output for the filter. One port of filter 10 is electrically connected to a resonator 22B at a suitable position thereon by a tap connector 36 via the center conductor of a connector 38. The connector may be connected to a 50 ohm source or load (not shown) by a length of conventional 50 ohm coaxial cable. Similarly, a tap connector 40 is electrically connected to a resonator 22G at a suitable position thereon at one end and at its other end to the center conductor of another connector 42. This connector is connected to a 50 ohm load or source via a length of 50 ohm conventional coaxial cable.

Receiver filter 10 is proportioned to operate in a frequency range of 835–849 MHz. The internal dimensions of the cavity C are 2.51 inches high, 1.03 inches wide, and 5.58 inches long. The resonators are round copper rods, 2.450 inches in length and having a diameter of five-sixteenth inch. They are spaced apart by a distance of 0.488 inch along a common plane in which their axes lie. Resonators 22A and 22G are each spaced about 0.234 inch from the end of the cavity. The housing plates are cooper sheet about 0.0625 inch thick.

As will be seen, a decoupler 30 is located between each pair of adjacent resonators. They are positioned along a center plane bisecting a plane including the axes of the adjacent resonators, but are offset from the including plane by different distances, consistent with the determined decoupling needs of the adjacent resonators. Decouplers 30 are each 0.250 inch in diameter.

Because the filter housing is made of copper and because the filter parts cannot be held to as precise and exact tolerances as are theoretically ideal, it is desirable to sometimes provide for some adjustability in the location and orientation of the bodies of the decouplers. To that end, for example, the openings in the plates 16, 18 to which the decouplers are secured may have oversized openings or slots, so that the screws 32 may be loosened, the decouplers shifted slightly, and then be fixed again by the screws 32. Also, the rods could be bent slightly or rods of different diameters, different cross-sectional configurations or shapes could be used, or even very thin rods, such as deformable wires, could be substituted under some circumstances. When screws are used, and the rods are not circular or where circular rods have elements projecting therefrom, rotation of the rod will change its decoupling effect and may also facilitate tuning. As such, the use of screws to allow rotation of the rods is desirable. Also, tuning screws could be placed in the decoupling rods along, and perpendicular to their lengths, and their projection adjusted.

Of course, either solid rods or hollow rods (tubes) can be used. If solid rods are used, then threaded holes for mounting via screws 32 must be provided. If hollow rods are used, then screws 32 which extend entirely through the rods and which are secured via nuts 32A may be employed, or the rod itself may be threaded and secured with nuts to the housing.

Figure 3:
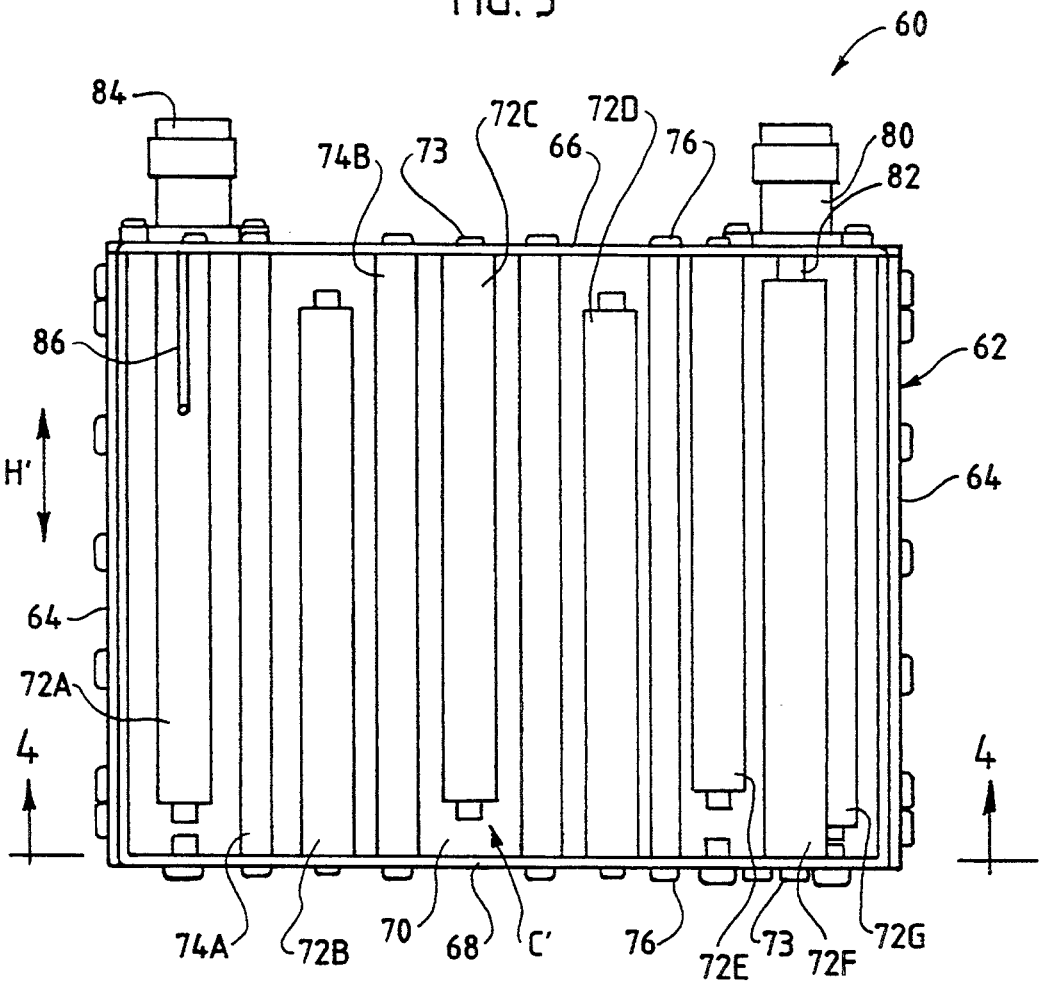
FIG. 3 is a side elevational view with a side plate removed, of an interdigital filter of the present invention.
Figure 4:
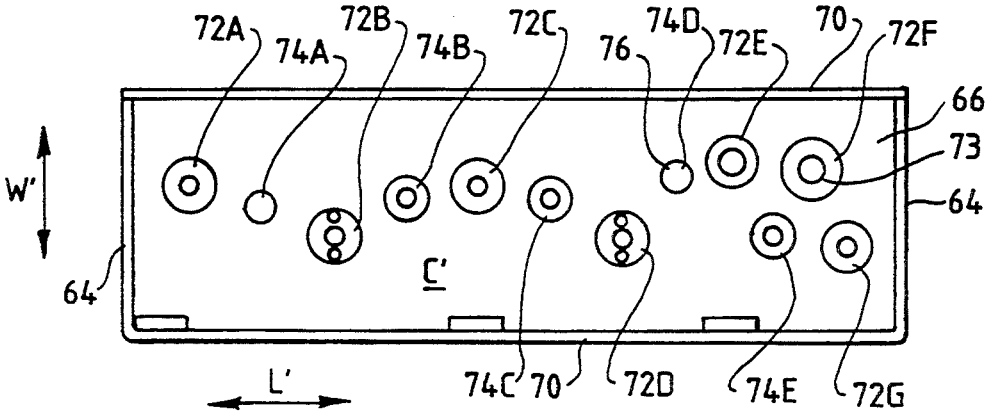
FIG. 4 is a sectional view taken along line 4—4 of FIG. 3.

Referring now to FIGS. 3 and 4, an interdigital transmitter filter 60 in accordance with the present invention includes an elongated generally rectangular conductive housing 62. Housing 62 is preferably metallic, as of copper. Housing 62 has a pair of end walls or plates 64 defining its length L′, a top wall or plate 66 and a bottom wall or plate 68 defining its height H′, and side walls or plates 70 defining its width W′. One plate 70 has been removed in FIG. 3 for clarity of illustration. The plates are connected in any suitable fashion to define a thin elongated rectangular cavity C′.

Inside the cavity a selected plurality of elongated resonators 72A, 72B, . . . 72G are disposed. Each of the resonators, in the embodiment shown is rod-like in shape, is metallic, as of copper, and is generally circular in transverse cross-section. All or some of the rods and housing plates may be coated with silver to provide high surface conductivity in accordance with conventional practice.

As may be seen in FIGS. 3 and 4, each resonator 72A, . . . has a length which is substantially greater than any dimension in transverse cross-section. Further, it will be seen that the resonators are arranged along the length of the housing with their lengths extending normal to the top plate 66 and bottom plate 68, hence parallel to and in the direction of the housing height H'. The resonators are each connected to the housing 62 adjacent an end of the resonator, and preferably to the adjacent end of the resonator, to provide a firm and secure mechanical and electrical connection. In filter 60, the resonators are connected to plates 66, 68 in alternating (interdigital fashion). Although a threaded fastener such as a screw 73 is a preferred method of connection, soldering, casting or the like may be used as well.

To reduce the spacing otherwise required between adjacent resonators to avoid excessive electrical coupling, hence degradation of operation, the filter 60 incorporates a plurality of decouplers 74A . . . 74E. Decouplers 74A are disposed in the housing between pairs of adjacent resonators. Each decoupler has a length which is greater than the lengths of the adjacent resonators, and extends in the same direction as (parallel to) the resonators. As may be seen each decoupler 74A . . . is secured mechanically and electrically grounded adjacent each end to the housing, and preferably by screws 76 which extend through the top and bottom plates into the ends of the decouplers 74A . . .

In the form illustrated, the decouplers 74A . . . are rods such as round rods, having openings at their ends to receive the screws 76. The decouplers in this case have diameters of 0.250 inch except for decouplers 74A and 74D which are 0.187 inch in diameter. However, the sizes used may be different, depending upon the requirements of the particular filter.

As viewed in transverse cross-section, the greatest transverse dimensions of the decouplers are less than that of the adjacent resonators. Desirably, the cross-sectional dimensions of each decoupler is such that its greatest dimension is preferably no more than about twice its smallest dimension. Further, the decouplers are secured to a maximum of two walls of the housing (both ends could be connected to a single side wall), and not to three or four plates of the housing.

Thus, despite the fact that the decouplers do not wall off or provide a mechanical barrier between the adjacent resonators, they function to effectively decouple adjacent resonators despite the fact that the physical distance between adjacent resonators would, in the absence of an associated decoupler, excessively couple and thereby detract from the operation of the adjacent resonators, and deleteriously affect the operation of the filter.

Like filter 10, filter 60 is provided with connectors for connecting the filter 60 to a 50 ohm source and load. Thus, coaxial connector 80 for the one connection has its center conductor connected to transformer rod 72F as by a tap connector 82 and coaxial connector 84 for the other connection has its center conductor connected to resonator 72A, as by a tap connector 86. The connectors 80, 84 are in turn connected, as by conventional coaxial cables to the 50 ohm source and load (not shown), respectively.

Transmitter filter 60 is proportioned to operate in a frequency range of 869 to 894 MHz. The internal dimensions of the cavity C' are 3.464 inches high, 1.4 inches wide and 4.625 inches long. The resonators are round copper rods. Their diameters and lengths vary as follows: 72A (0.312 inch; 3.180 inches); 72B (0.312 inch; 3.145 inches); 72C (0.312 inch; 3.145 inches); 72D (0.312 inch; 3.145 inches); 72E (0.312 inch; 3.080 inches); 72G (0.312 inch; 3.275 inches). Transformer rod 72F has a diameter of 0.375 inch and is 3.33 inches in length. As seen they are connected in alternating (interdigital) fashion to plates 66, 68. They are spaced apart from each other by varying distances which are shown proportionally by their centers in FIG. 4, in which the distance between the centers of resonators 72A and 72B is 0.898 inch. The housing plates are copper sheet about 0.0625 inch thick.

As seen, decouplers 74A . . . are disposed between a plurality of pairs of the resonators 72A . . . In this embodiment their positioning, shown to scale in FIG. 4, relative to the adjacent resonators varies, and is not equidistant. The spacing has been determined with the aid of numerical analysis, consistent with optimal operation of the filter. Indeed, as shown at the right hand side of FIG. 4, a single decoupler 74E may be viewed as being positioned between three pairs of adjacent rods 72E, 72F; 72F, 72G; and 72E, 72G.

Finally, like filter 10, filter 60 may be provided with means for adjusting the location, orientation or decoupling capacity of decouplers 74, such as via oversized openings, slots or the other adjusting means described in connection with the embodiment of FIGS. 1 and 2.

It is apparent that the filters of FIGS. 1 through 4 may have counterparts used for both transmitter and receiver filters, and that the principles described may be employed in adjoining duplexer filters.

Figure 5:
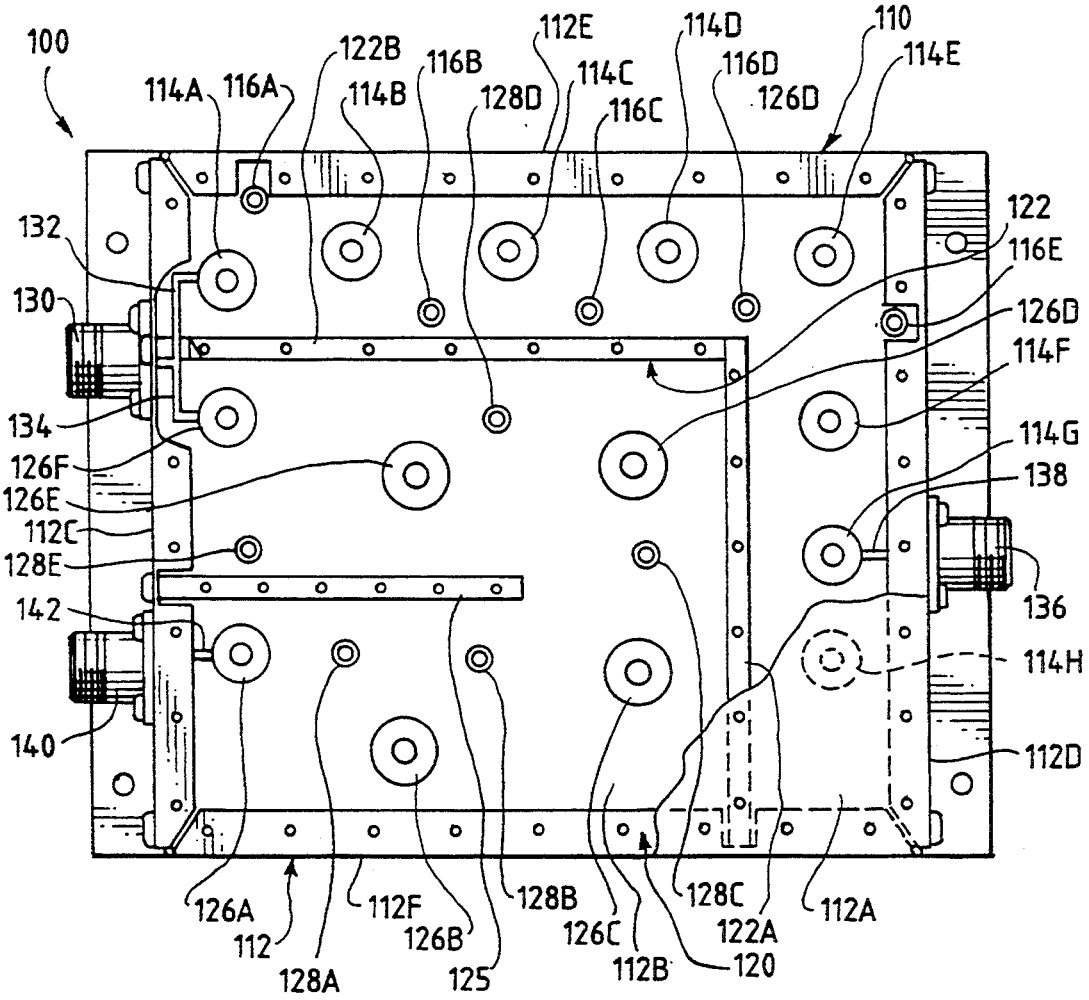
FIG. 5 is a top plan view, with most of the top plate and associated fasteners removed, of a duplexer having transmitter and receiver filters in accordance with the present invention.

Yet another filter employing decouplers to reduce the required size of an array of resonators is shown in FIG. 5. In this embodiment, a multiplexer such as duplexer 100 comprising a receiver filter section 110 and a transmitter filter section 120 is shown.

In this embodiment, filter section 110 includes a housing 112 which defines a cavity which is elongated and L-shaped, and which houses a plurality of resonators 114A–114H. A plurality of receiver decouplers 116A–116E are disposed between adjacent pairs of resonators. In some cases, the decouplers act to decouple more than one pair of resonators. Thus, decoupler 116D may serve to decouple resonator pairs 114D, 114E; 114D, 114F; and 114E, 114F. Other decouplers may serve only one pair of resonators, such as 116C acting to decouple resonators 114C, 114D. The relative positions of the resonators and decouplers are shown in FIG. 5 approximately to scale. The resonator rods are disposed in a combline array and are secured to the bottom plate 112B of the housing 112.

The legs of the L-shaped filter section housing are bordered internally of the duplexer by a wall 122, having wall portions 122A and 122B. Thus, the housing and the L-shaped receiver filter cavity are defined by a portion of end wall 112C, side wall 112E and wall portion 122B, end wall 112D and wall portion 122A, and by a portion of side wall 112F, as well as by top and bottom plates 112A and 112B. All of these portions are preferably of copper which may be silver plated in conventional fashion or copper or silver plated aluminum, plastic or ceramic, to provide an optimal cavity for housing the associated resonators.

The distance between end walls 112C and 112D is 7.048 inches and the distance between side walls 112E and 112F is 6.122 inches. The distance between wall 112E and wall plates 122B is 1.715 inches; and the distance between wall portion 122 and wall 112D is 1.735 inches. The distance between plates 112A and 112B is 3.0 inches. The decoupler rods are secured at each of their ends to plates 112A and 112B in the same manner as described above.

The transmitter filter section 120 is separated from the receiver section 110 by the L-shaped divider wall 122 which helps define the cavity for the receiver filter and which, with other portions of the housing 112, defines the transmitter filter cavity. Thus, the transmitter filter section has the same top and bottom plates 112A, 112B as does the receiver filter section. The ends of the transmitter filter section are housing wall 112C and wall portion 122A (spaced by about 5.314 inches). The sides of the transmitter filter section are housing wall 112F and wall portion 122B (spaced by about 4.407 inches).

Additionally, transmitter filter section 120 includes an isolation wall 125 which is electrically and mechanically connected to plates 112A, 112B, and to wall 112C as well. Thus, the transmitter cavity is generally U-shaped in configuration and has three legs with some of the associated resonators and decouplers being disposed in each of the legs.

Section 120 includes a plurality of resonators 126A–126F, as well as a plurality of decouplers 128A–128E, which are associated with each pair of adjacent resonators, in some cases physically between the adjacent pair of resonators, and in other cases offset therefrom, as may be clearly seen in FIG. 5. For example, decoupler 128B is associated with resonators 126B and 126C and is also associated with resonators 126B and 126D, thus serving to decouple both pairs of resonators. The decouplers may be mounted by screws to plates 112A and 112B for adjustment, as via oversized holes, slots or the like.

The duplexer is provided with an antenna coaxial connector 130, the center conductor of which is electrically connected by tap connectors 132, 134 to the receiver and transmitter filters at receiver filter resonator 114A and at transmitter filter resonator 126F. A receiver filter connector 136 is electrically connected by a tap connector 138 to resonator 114G and a transmitter filter connector 140 is electrically connected by a tap connector 142 to a resonator 126A.

The ranges of frequencies at which the filters of the duplexer of FIG. 5 operate may be 870–885 MHz for the transmit band and 925–960 MHz for the receive band.

It will be apparent from the foregoing that unlike mechanical barriers connected to three filter surfaces, which serve as electrical barriers to prevent or minimize coupling of proximate resonators, such as does barrier wall 125, the decouplers of the present invention are inexpensive to manufacture and install, may be easily adjusted, and facilitate the manufacture of substantially more compact filters.

Figure 6:
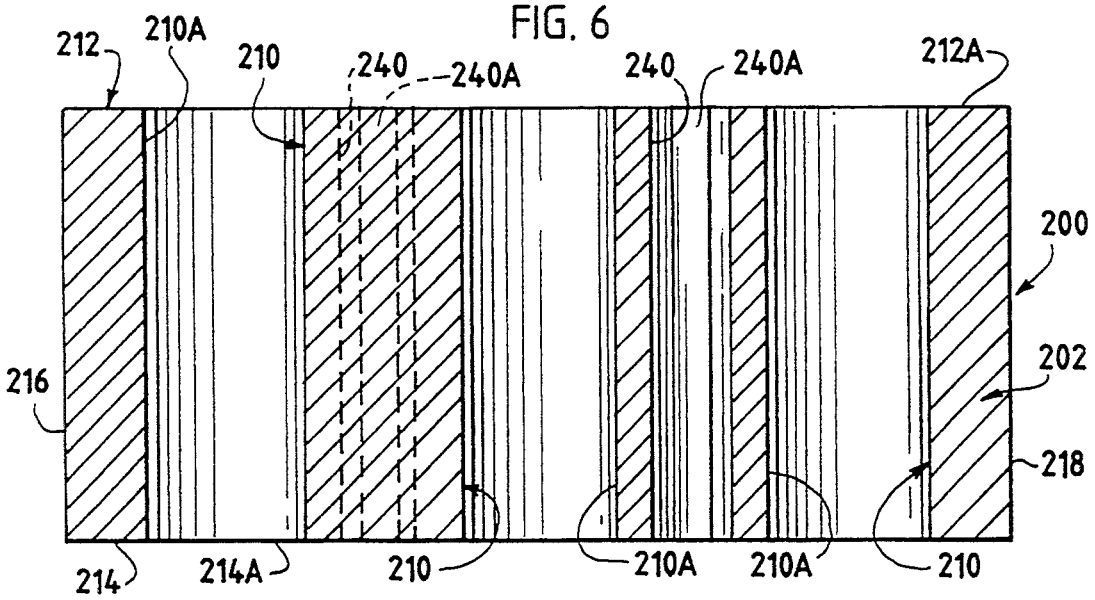
FIG. 6 is a cross-sectional view taken substantially along line 6—6 of FIG. 7, and is of a further combline filter of the present invention.

Referring now to FIG. 6, there is shown, in schematic form, a further combline filter 200 of a monolithic block dielectric type of a known ceramic material, such as barium titanate ($BaO.TiO_2$) having a dielectric constant of about 34. As there shown, the dielectric block 202 defines a first plurality of elongated cylindrical resonator cavities or holes 210 and a second plurality of cylindrical decoupler cavities or holes 240 of a diameter which is less than that of holes 210. The holes are each greater in length than their largest dimensions in transverse cross-section.

Holes 210 extend from one wall surface 212 of block 202 and to the opposite wall surface 214, and their axes are generally normal to surfaces 212 and 214. Alternatively, the resonator holes may terminate short of one wall surface to provide blind holes. The axes of holes 210 also lie generally parallel to the end walls 216, 218 and side walls 220, 222, and are arrayed along the length of block 202 between end walls 216, 218.

Figure 8:
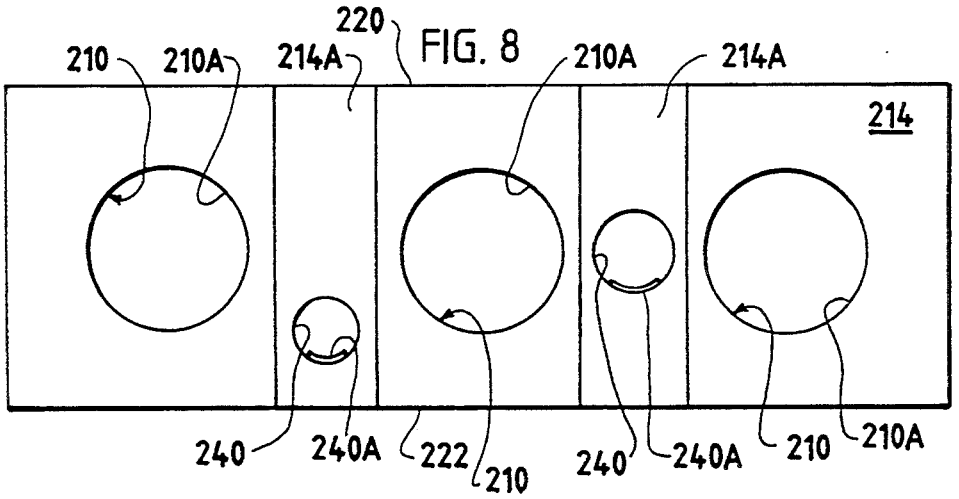
FIG. 8 is a bottom view of the combline filter of FIG. 6.

As shown, the resonator holes 210 are covered or metalized with a conductive film 210A, as are the surfaces and walls 212, 216, 218, 220, 222 and portions of surface 214 (as shown in FIG. 8) of the block. The decoupler holes 240 are also metalized at least in part between wall surfaces 212, 214, as by an arcuate partial covering conductive layer 240A, electrically coupled at one end to the conductive surface or film 212A on the surface 212 and at the other end to the conductive surface or film sections 214A on parts of surface 214.

Figure 7:
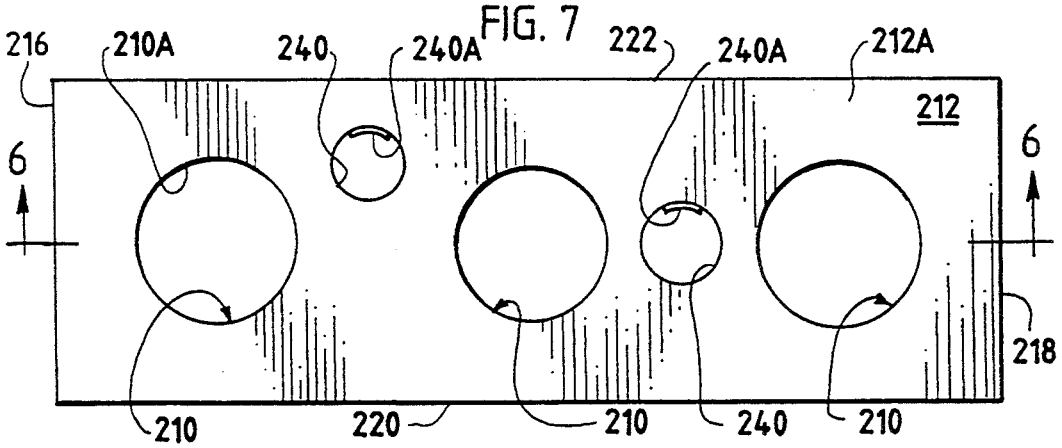
FIG. 7 is a top plan view of the combline filter of FIG. 6.

The decoupler holes thus may be grounded at each end. As shown by FIGS. 7 and 8, the resonator hole axes may lie along a common plane, or they may be offset. Similarly, the decoupler hole axes may lie along the same common plane, or some or all may be offset as shown.

Although the decoupler holes are shown as round holes they may be of other shapes as well. Preferably a decoupler hole lies between each pair of adjacent resonator holes. Clearly, the location, size and relationship of the decoupler holes, like those of the decoupler rods and shapes of the other embodiments described above will depend upon the positions of the resonator holes, their size, shapes and proximity, and the coupling relationship required by the adjacent resonator holes.

Like the filters of FIGS. 1–5, input and output connectors may be secured to the filter of FIGS. 6–8 and selected resonators, and other features for adjusting the resonator holes and the like may be provided, all in manners known to and suggested by the prior art (such as inserting metal or dielectric coupling tuning screws or slugs in partially metalized decoupling holes). It will also be apparent that the resonator holes of the filter may be arrayed in a interdigital array as exemplified by FIGS. 3 and 4, rather than in the combline array illustrated by FIGS. 6 to 8.

The above described embodiments of the invention are examples of ways in which the invention may be carried out within the spirit and scope of the invention. Other ways of practicing the invention will become apparent to those skilled in the art from the foregoing. As such, the invention is intended to be limited only as may be necessary in view of the appended claims.

What is claimed is:

1. An RF band-pass filter comprising a generally rectangular conductive housing defining a cavity, a plurality of elongated resonators in said cavity and a plurality of elongated resonator decouplers in said cavity, one decoupler being positioned adjacent each of a plurality of pairs of adjacent elongated resonators, said cavity having a length defined by housing ends, a width defined by housing sides, and a height defined by a housing top and a housing bottom, said housing ends, sides, and top being conductive plates, each said resonator being elongated and having a length which is substantially greater than its greatest transverse cross-sectional width, said resonators being arrayed along the length of said cavity with their lengths extending in the direction of said housing height, each said resonator being electrically connected adjacent one of its ends to said housing, each said resonator decoupler being a rod having a length which is at least equal to that of the resonators and with its length extending in the same direction as the lengths of an adjacent pair of resonators, and wherein the greatest transverse cross-sectional width of said decoupler is less than the greatest transverse cross-sectional width of said pairs of adjacent resonators and no more than twice the smallest transverse cross-sectional width of said decoupler, each said decoupler being electrically connected to said housing at each of its ends.

2. An RF band-pass filter in accordance with claim 1, and wherein said filter is an interdigital filter.

3. An RF band-pass filter in accordance with claim 2, and wherein said interdigital filter comprises resonators which are rods, each of which is connected alternately to a said top and bottom plate.

4. An RF band-pass filter in accordance with claim 1, and wherein said filter is a combline filter.

5. An RF band-pass filter in accordance with claim 3, and wherein said combline filter comprises resonators which are rods, each of which is connected to one of said plates.

6. An RF band-pass filter comprising a generally rectangular conductive housing defining an enclosed cavity, a plurality of elongated resonators in said cavity and a plurality of elongated resonator decouplers in said cavity, one decoupler being positioned adjacent each of a plurality of pairs of adjacent elongated resonators, said housing having a height defined by a housing top and housing bottom, each said resonator being elongate and having a length which is substantially greater than its greatest transverse cross-sectional width, said resonators being disposed in a spaced parallel array within said cavity with their lengths extending parallel to the direction of said housing height, each said resonator being electrically connected adjacent one of its ends to said housing, each said resonator decoupler being a rod having a length which is at least equal to that of the resonators and with its length extending in the same direction as the lengths of an adjacent pair of resonators, and wherein the greatest transverse cross-sectional width of said decoupler is less than the greatest transverse cross-sectional width of said pairs of adjacent resonators and no more than about twice the smallest transverse cross-sectional width of said decoupler, each said decoupler being electrically connected to said housing only at the ends of said decouplers.

7. An RF band-pass filter in accordance with claim 6, and wherein said filter is an interdigital filter.

8. An RF band-pass filter in accordance with claim 7, and wherein said interdigital filter comprises resonators which are rods, each of which is connected alternately to a said top and bottom plates.

9. An RF band-pass filter in accordance with claim 6, and wherein said filter is a combline filter.

10. An RF band-pass filter in accordance with claim 9, and wherein said combline filter comprises resonators which are rods, each of which is connected to one of said plates.

11. An RF band-pass filter in accordance with claim 6, and wherein said housing defines an elongated cavity having an L-shape formed by a pair of perpendicular legs, with a plurality of said resonators being disposed in each of said legs and with decouplers in at least one of said legs.

12. An RF band-pass filter in accordance with claim 6, and wherein said housing defines an elongated cavity having a U-shape formed by three legs including first and second perpendicular legs and a third leg parallel to said first leg and perpendicular to said second leg, with a plurality of said resonators and a plurality of said decouplers being disposed in more than one of said legs.

13. A generally rectangular RF filter having a plurality of elongated resonators and a plurality of elongated resonator decouplers, one decoupler being positioned adjacent each of a plurality of pairs of adjacent elongated resonators, said filter having a length defined by ends, a width defined by side walls, and a height defined by a top wall and a bottom wall, said filter ends, side walls, and top wall and bottom wall being conductive plates defining a cavity, with said resonators and said resonator decouplers being positioned in said cavity, each said resonator being elongate and having a length which is substantially greater than its greatest transverse cross-sectional width, said resonators being arrayed along the length of said filter with their lengths extending in the direction of said filter height, each said resonator being electrically connected adjacent one of its ends to one of said conductive plates, each said resonator decoupler being a rod having a length which is at least equal to that of the resonators and with its length extending in the same direction as the lengths of an adjacent pair of resonators, and wherein the greatest transverse cross-sectional width of said decoupler is less than the greatest transverse cross-sectional width of said pairs of adjacent resonators, each said decoupler being electrically connected to said top and bottom plates at each of its ends.

* * * * *

UNITED STATES PATENT AND TRADEMARK OFFICE

CERTIFICATE OF CORRECTION

PATENT NO. : 5,428,325

DATED : June 27, 1995

INVENTOR(S) : Jachowski, et al.

It is certified that error appears in the above-identified patent and that said Letters Patent is hereby corrected as shown below:

Column 9, line 30 (Claim 5, line 1), numeral "3" should be —4—.

Signed and Sealed this

Nineteenth Day of September, 1995

*Attest:*

Bruce Lehman

BRUCE LEHMAN

*Attesting Officer*

*Commissioner of Patents and Trademarks*